US007901187B2

(12) United States Patent
Barber

(10) Patent No.: US 7,901,187 B2
(45) Date of Patent: Mar. 8, 2011

(54) TURBINE ROTOR BLADE GROOVE ENTRY SLOT LOCK STRUCTURE

(75) Inventor: Ralph Rickie Barber, Charlotte, NC (US)

(73) Assignee: Siemens Energy, Inc., Orlando, FL (US)

( * ) Notice: Subject to any disclaimer, the term of this patent is extended or adjusted under 35 U.S.C. 154(b) by 942 days.

(21) Appl. No.: 11/811,090

(22) Filed: Jun. 8, 2007

(65) Prior Publication Data

US 2007/0297908 A1 Dec. 27, 2007

Related U.S. Application Data

(60) Provisional application No. 60/816,008, filed on Jun. 23, 2006.

(51) Int. Cl.
*F01D 5/32* (2006.01)

(52) U.S. Cl. ..... 416/216; 416/215; 416/218; 29/889.1; 29/889.21

(58) Field of Classification Search ..... 416/215–218, 416/220 R; 29/889.1, 889.21
See application file for complete search history.

(56) References Cited

U.S. PATENT DOCUMENTS

| | | | | |
|---|---|---|---|---|
| 1,673,935 | A * | 6/1928 | Cares | 416/216 |
| 1,687,891 | A | 10/1928 | Ray | |
| 1,829,881 | A | 4/1930 | Tucker | |
| 2,315,631 | A | 4/1943 | Lloyd et al. | |
| 2,528,305 | A | 10/1950 | Gubler | |
| 2,846,183 | A | 8/1958 | Morgan | |
| 2,918,255 | A | 12/1959 | McGinnis | |
| 3,042,368 | A * | 7/1962 | Cook | 416/216 |
| 3,088,708 | A | 5/1963 | Feinberg | |
| 3,199,836 | A | 8/1965 | Moyer | |
| 3,644,058 | A | 2/1972 | Barnabei et al. | |
| 3,721,506 | A | 3/1973 | Anderson | |
| 3,954,350 | A | 5/1976 | Zahring | |
| 4,676,723 | A | 6/1987 | Kiger et al. | |
| 4,767,275 | A | 8/1988 | Brown | |
| 4,836,749 | A | 6/1989 | Gavilan | |
| 5,161,951 | A | 11/1992 | Hackstie et al. | |
| H1258 | H | 12/1993 | Hindle, Jr. | |
| 6,431,836 | B2 | 8/2002 | Zimmermann | |
| 6,638,006 | B2 | 10/2003 | Selby | |
| 2001/0022936 | A1 | 9/2001 | Zimmermamm | |
| 2004/0120817 | A1 | 6/2004 | Shapiro et al. | |

FOREIGN PATENT DOCUMENTS

| | | |
|---|---|---|
| EP | 1321630 A2 | 12/2003 |
| GB | 704882 | 3/1954 |

* cited by examiner

*Primary Examiner* — Christopher Verdier

(57) ABSTRACT

A blade lock structure for blading an axial flow turbine having a rotor and blades. The blades are inserted into an undercut blade groove of the rotor providing a positive lock between the blades and the rotor. The lock structure includes an entry slot located in the blade groove for receiving the blades for insertion to the undercut blade groove, and an insert space axially extending from the entry slot. The insert space defines a radially extending longitudinal axis. An insert piece is located in positive-locking relationship with the insert space, and a lock screw threadably engages between the insert piece and a closing blade inserted to the entry slot.

17 Claims, 3 Drawing Sheets

TURBINE ROTOR BLADE GROOVE ENTRY SLOT LOCK STRUCTURE

CROSS-REFERENCE TO RELATED APPLICATIONS

This application claims the benefit of U.S. Provisional Application No. 60/816,008, filed Jun. 23, 2006, which is incorporated herein by reference.

FIELD OF THE INVENTION

The present invention relates generally to a blade lock for use in blading an axial flow turbine and, more particularly, to a blade lock including a removable insert piece cooperating with a blade through a lock screw.

BACKGROUND OF THE INVENTION

During a known blading operation for axial flow turbines, blades are successively mounted to a circumferential groove formed in a rotor by inserting the blade roots radially into an entry slot and then circumferentially moving the blades through the circumferential groove. The circumferential groove is formed to define an undercut blade groove to receive an inverted T-shaped, i.e., a hammerhead or double hammerhead, portion of the blade root in a positive-locking manner. The entry slot comprises an area of the circumferential groove that is formed without the undercut, such that the last blade inserted and remaining in the location of the entry slot must be retained by a locking means.

One known means for retaining the last blade, or closing blade, comprises drilling and tapping a locking hole at the junction between the rotor surface defining the groove and the closing blade, such that a half-hole is defined in each of the rotor and the closing blade to receive a lock screw. Threaded engagement of the screw with the threads of the half-holes prevents radial movement of the closing blade out of the circumferential groove. In the event that repairs must be performed, such as replacement of the blades, the locking hole may be re-tapped with the next largest lock screw size, or an even larger screw size, as part of the operation of locking the replacement blades in place. Eventually, with multiple blade replacements, the threads of the locking hole will reach a maximum allowable size and require more extensive repair.

Accordingly, there continues to be a need for a blade lock structure that operates to securely lock the blades in place and that provides efficiencies during multiple blade replacement procedures.

SUMMARY OF THE INVENTION

In accordance with one aspect of the invention, a blade lock structure is provided for blading an axial flow turbine having a rotor and blades, wherein the blades are inserted into an undercut blade groove of the rotor providing a positive lock between the blades and the rotor. The lock structure comprises an entry slot located in the blade groove for receiving the blades for insertion to the undercut blade groove, and an insert space axially extending from the entry slot, the insert space defining a radially extending longitudinal axis. An insert piece is located in positive-locking relationship with the insert space, and a lock screw threadably engages between the insert piece and one of the blades.

In accordance with another aspect of the invention, a blade lock structure is provided comprising a rotor defining a circumferential groove, the rotor also defining an insert space extending from the circumferential groove. An insert piece is insertable into the insert space, and a lock screw is threadably engagable between the insert piece and a blade located within the circumferential groove.

In accordance with a further aspect of the invention, a process is provided for repairing a blade lock structure for blading an axial flow turbine having a rotor defining a circumferential groove and blades, where the rotor is also provided with an insert space extending from the circumferential groove, the insert space defining a radially extending longitudinal axis. The process comprises the steps of inserting an insert piece into the insert space, inserting a blade in the circumferential groove adjacent the insert piece, drilling and tapping a hole between the insert piece and the blade, and threadably engaging a lock screw in the hole.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
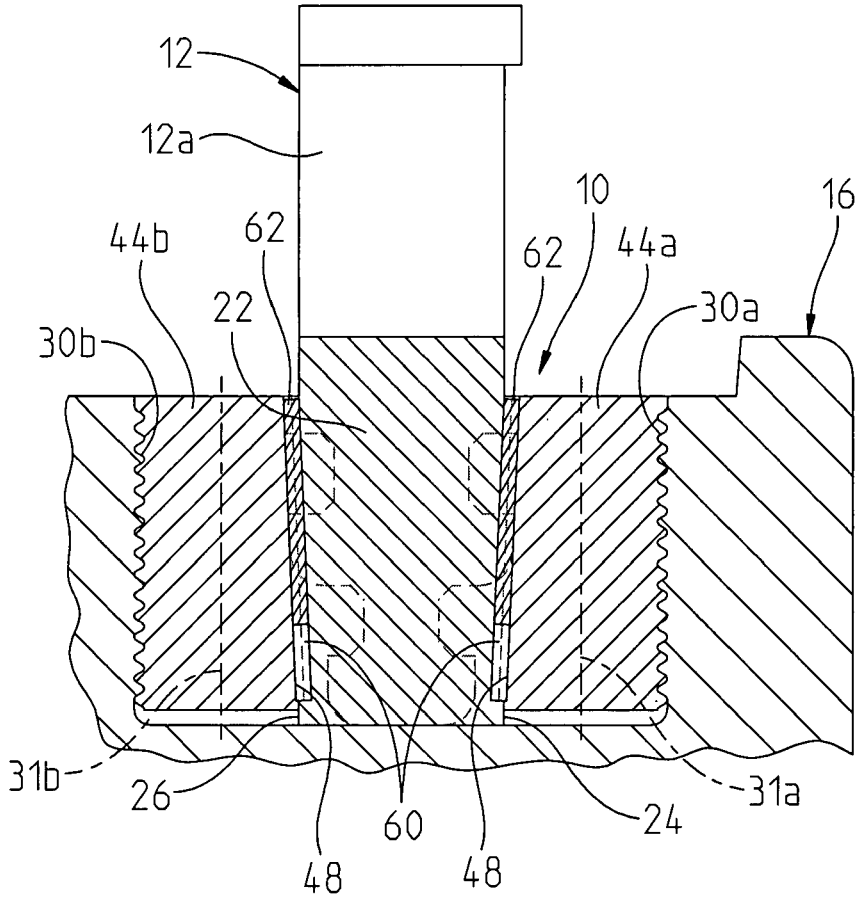
FIG. 1 is cross-sectional view of a detail of a turbine rotor taken at a blade entry slot of a blade groove, along a line depicted by line 1-1 in FIG. 4.
Figure 2:
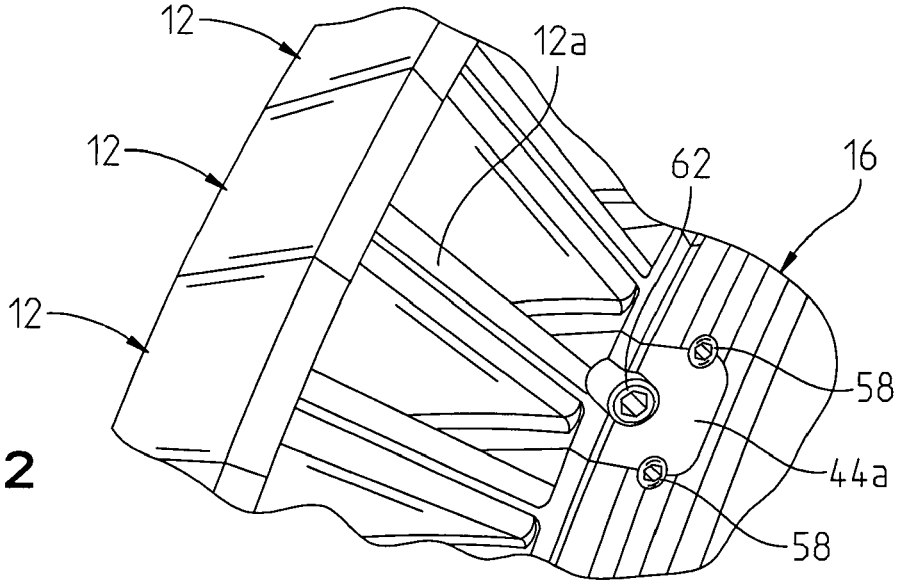
FIG. 2 is a perspective view of a portion of a turbine rotor including an insert piece.

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Referring to FIGS. 1-4, the present invention relates to providing a blade lock structure 10 for use in a blading operation for installing blades, as depicted for example by a plurality of row one blades 12, into an undercut circumferential groove 14 defined in a rotor disc 16. The undercut of the groove 14 is formed by one or more opposing pairs of shoulders, depicted here as shoulder pairs 18 and 20 (FIG. 3), which is shown in this exemplary embodiment configured for receiving a blade root of double hammerhead configuration (not shown). The groove 14 receives a set of blades comprising a plurality of similar blades 12 having the double hammerhead configuration conforming to the undercut shape of the groove 14.

As seen in FIG. 1, a last inserted blade or closing blade 12, particularly identified as 12*a*, is provided with a blade root 22 having a different configuration than the other blades 12 of the blade set. In particular, the root 22 of blade 12*a* comprises a generally planar axially facing inlet face 24 and a generally planar axially facing exit face 26. In addition, a pair of parallel generally planar axially extending sides (not shown) connect the inlet and exit faces 24, 26 to define a parallelogram configuration for the blade root 22.

Figure 4:
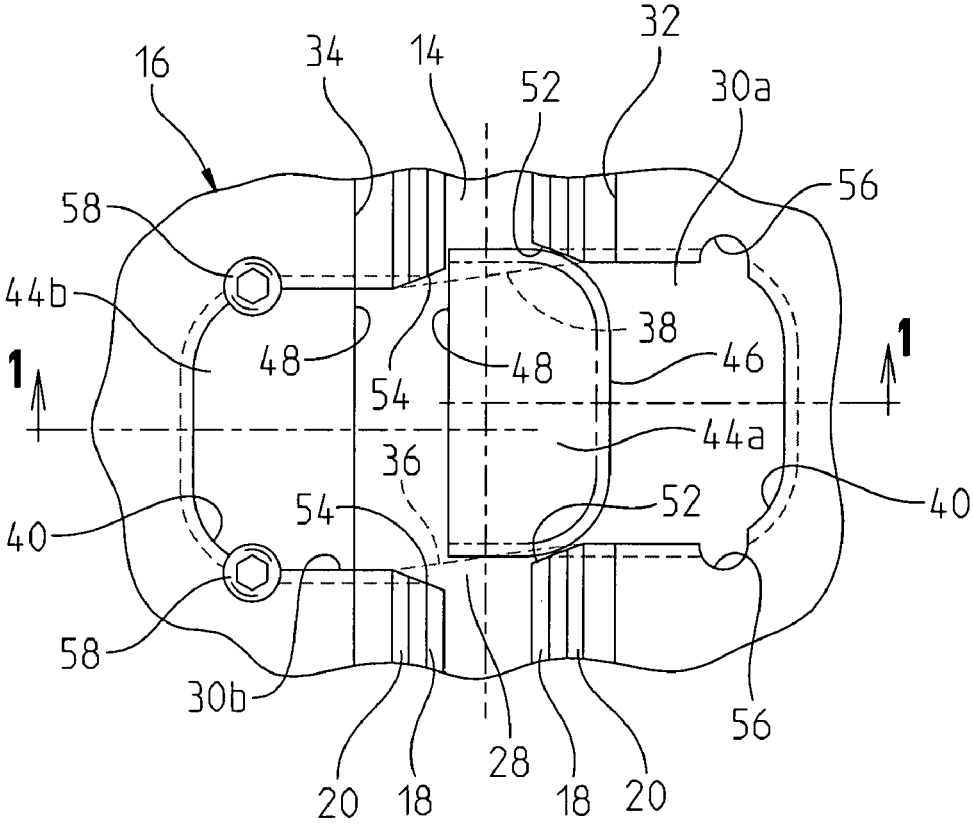
FIG. 4 is plan view of the entry slot of the blade groove with the exit insert piece located in position and showing the inlet insert piece prior to insertion to the inlet insert space.

As seen in FIG. 4, the shoulder pairs 18, 20 are discontinued at least at one point comprising an entry slot 28 located in the groove 14. The entry slot 28 provides an area where the blades 12 with the double hammerhead root configuration may be initially inserted to the groove 14, and subsequently slide circumferentially within the undercut area defined by the shoulder pairs 18, 20 to provide a positive lock between the rotor disc 16 and the blades 12. The root 22 of the closing blade 12*a* is also sized to fit within and substantially fill the space provided by the entry slot 28.

An inlet insert space 30*a* axially extends from an inlet side 32 of the entry slot 28, and an exit insert space 30*b* axially extends from an exit side 34 of the entry slot 28 at a side of the groove 14 opposite the inlet insert space 30*a*. The insert spaces 30*a*, 30*b* each define a respective radially extending longitudinal axis 31*a*, 31*b*, and have a substantially U-shaped configuration. The insert spaces 30*a*, 30*b* may be circumferentially displaced from each other to correspond to the parallelogram configuration of the root 22, where it may be understood that the inlet face 24 of the blade root 22 is circumferentially offset from the exit face 26, and the axially extending sides of the blade root 22 extend at an angle to the longitudinal axis of the rotor disc 16, as depicted diagrammatically by the parallel lines 36, 38.

Figure 3:
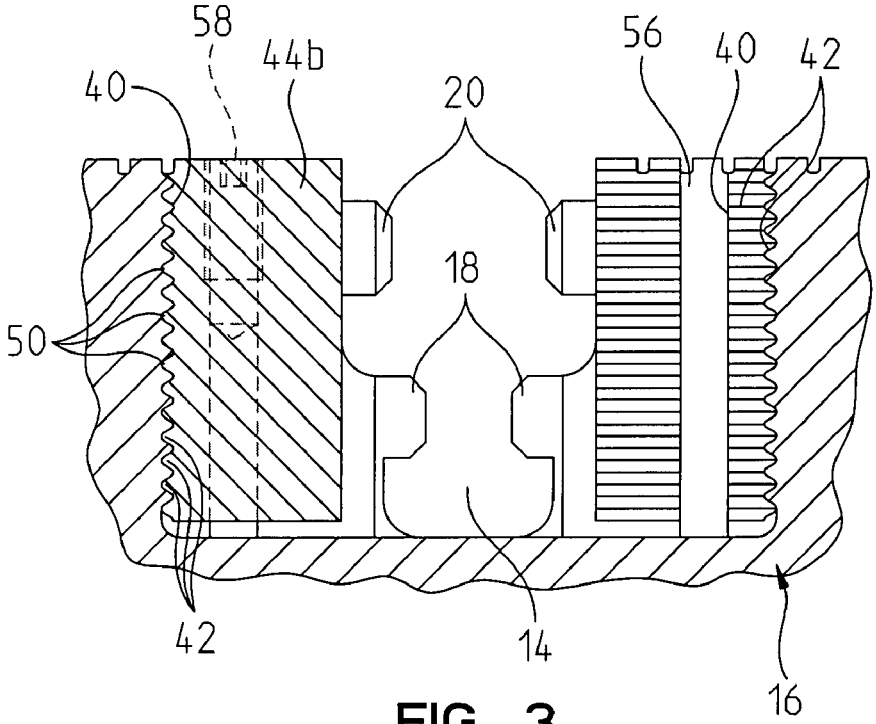
FIG. 3 is cross-sectional view of a blade entry slot and inlet and exit insert spaces with an insert piece located in the exit insert space.
Figure 5:
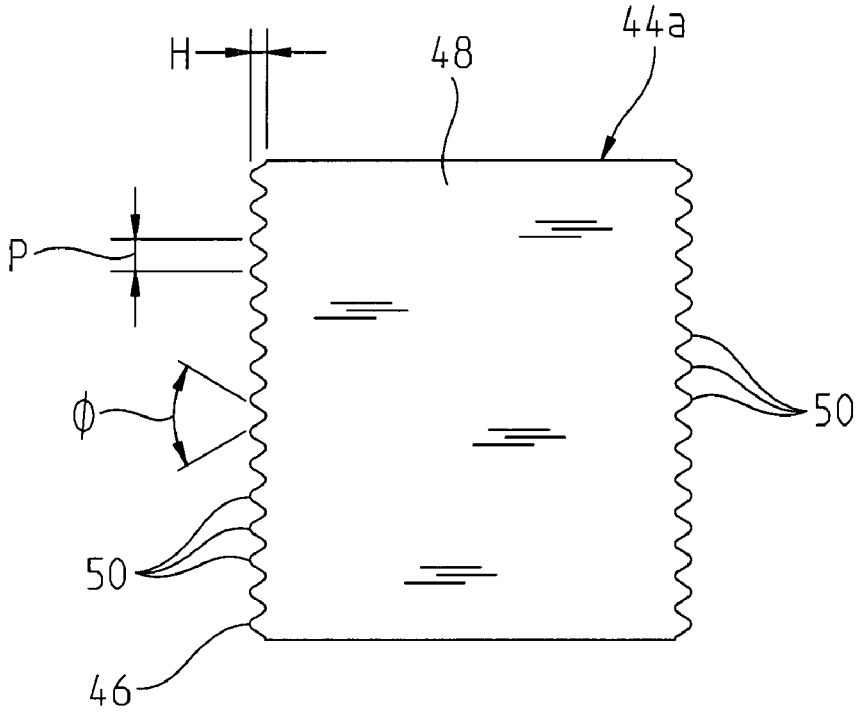
FIG. 5 is an elevation view of an insert piece taken from the blade engaging side of the insert piece.
Figure 6:
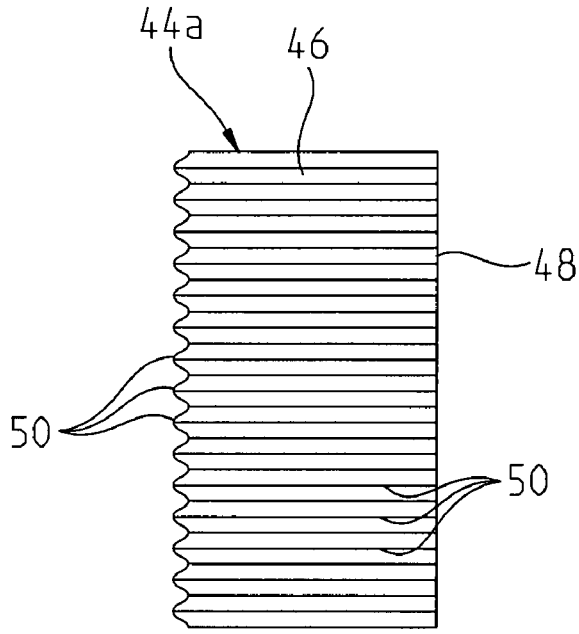
FIG. 6 is an elevation view of the insert piece, taken at 90 degrees to the view of FIG. 5.

As seen in FIG. 3, the inlet spaces 30*a*, 30*b* are defined by axially and radially extending side walls 40. The side walls 40 are machined or otherwise formed with generally V-shaped thread features 42 to provide the side walls 40 with a serrated surface. The inlet and exit insert spaces 30*a*, 30*b* are configured to receive inlet and exit insert pieces 44*a* and 44*b*, respectively. Specifically, the inlet and exit insert pieces 44*a*, 44*b* each comprise unitary members including an outer wall 46 having opposing axially extending sides, and a blade engaging face 48 extending between the axially extending sides, as depicted by insert piece 44*a* in FIGS. 5 and 6. The outer wall 46 has a height, in the radial direction, that is equal to or slightly less than the radial depth of the insert spaces 30*a*, 30*b*. In addition, the outer wall 46 is formed with generally V-shaped thread features 50 extending circumferentially about the outer wall 46, extending along the sides of the insert pieces 44*a*, 44*b* and around a portion of the outer wall 46 extending between the opposing sides of the outer wall 46, to provide the outer wall 46 with a serrated surface matching the serrated surface of the insert space side walls 40.

The insert pieces 44*a*, 44*b* are configured as U-shaped members and have circumferentially and radially extending dimensions that are substantially the same as the corresponding dimensions of the insert spaces 30*a*, 30*b*. Each insert piece 44*a*, 44*b* may be inserted into the corresponding insert space 30*a*, 30*b* by first inserting the insert piece 44*a*, 44*b* radially into the entry slot 28, as illustrated by insert piece 44*a* in FIG. 4, and then moving the insert piece 44*a*, 44*b* axially, i.e., transverse to the longitudinal axes 31*a*, 31*b*, into its insert space 30*a*, 30*b*. Axial movement of the insert pieces 44*a*, 44*b* into the insert spaces 30*a*, 30*b* places the V-shaped features 42 and 50 into engagement with one another to lock the insert pieces 44*a*, 44*b* against radial movement out of the spaces 30*a*, 30*b*. When the insert pieces 44*a*, 44*b* have been located in position within the insert spaces 30*a*, 30*b*, the blade engaging face 48 of each of the insert pieces 44*a*, 44*b* defines a circumferentially extending surface comprising a generally planar wall within the circumferential groove 14.

It should be noted that at the openings to the inlet and exit insert spaces 30*a*, 30*b*, respective angled inlet cutout portions 52 and exit cutout portions 54 may be provided in the shoulder pairs 18, 20 to facilitate clearance of the insert pieces 44*a*, 44*b* as they are inserted to the entry slot 28, as seen in FIG. 4.

Referring to FIGS. 3 and 4, each insert space 30*a*, 30*b* may be provided with one or more half-holes 56. After the insert piece 44*a*, 44*b* is positioned within the insert space 30*a*, 30*b*, the insert piece 44*a*, 44*b* may be drilled at the location of each half-hole 56 to form a matching half-hole in the insert piece 44*a*, 44*b* which may then be tapped to define an insert locking passage extending generally parallel to the longitudinal axes 31*a*, 31*b* for receiving a locking member comprising a stud screw 58. The stud screw 58 prevents the insert piece 44*a*, 44*b* from moving axially out of the insert space 30*a*, 30*b*. The stud screw 58 also further locks the insert piece 44*a*, 44*b* against radial movement out of the space 30*a*, 30*b*.

In an installation procedure, after both of the insert pieces 44*a*, 44*b* are located in their respective insert spaces 30*a*, 30*b*, the closing blade 12*a* is inserted into the entry slot 28 where the inlet and exit faces 24, 26 of the blade root 22 are positioned in engagement with the blade engaging faces 48 of the insert pieces 44*a*, 44*b*. A hole 60 is then drilled and tapped at the junctions between the insert pieces 44*a*, 44*b* and the blade 12*a*, and a lock screw 62 is threaded into each of the holes 60, where the threads of the lock screws 62 engage adjacent half-holes in the insert pieces 44*a*, 44*b* and the blade 12*a* to lock the blade 12*a* against radial movement out of the circumferential groove 14.

Further, the V-shaped features 42, 50 are designed such that they are able to withstand the centrifugal force loads applied from the insert piece 44*a*, 44*b* as well as loads applied by the closing blade 12*a* and lock screw 62. For example, in a particular design of the features 42, 50, as illustrated on the features 50 in FIG. 5, the features 50 may be formed with a thread height, H, of 2.15 mm, a pitch, P, of 4.23 mm and a basic angle of thread, $\phi$, of 60°.

It should be understood that within the scope of the invention, the insert pieces 44*a*, 44*b* may be retained in position by either the stud screws 58 or the features 42, 50, or may be retained by both structures, as is illustrated herein. Alternatively, the stud screws 58 could be replaced by unthreaded dowel members to retain the insert pieces 44*a*, 44*b* against axial movement transverse to the longitudinal axes 31*a*, 31*b*, and retention of the insert pieces 44*a*, 44*b* against radial movement may be effected through the cooperating features 42, 50.

The present invention may be provided on new turbine rotors or may be provided as a repair for existing turbine rotors in which the original blade lock structure comprises a lock screw provided as a locking element directly between a blade surface and a cooperating surface integral with the turbine rotor. For example, in a repair operation, the rotor disc of a turbine may be machined to form the described inlet and exit insert spaces 30*a*, 30*b* for receiving the insert pieces 44*a*, 44*b* in the installation procedure described above.

Alternatively, the present invention may be applied to replace lock structures incorporating multiple locking pieces for holding the last inserted blade in place, such as lock structures including wedged filler pieces provided adjacent the blade root. An example of such a structure is disclosed in U.S. Pat. No. 6,431,836, which patent is incorporated herein by reference. In accordance with the present invention, the prior art structure comprising a mounting region for receiving multiple components, such as a filler piece and a wedge, may be re-machined to conform to the presently described insert spaces 30*a*, 30*b* for mounting a closing blade 12*a* using the insert pieces 44*a*, 44*b*.

It may be noted that in a typical installation procedure performed as part of a re-blading process for the rotor disc 16, the closing blade 12*a* is provided without a hole or half-hole for cooperating with an adjacent insert piece 44*a*, 44*b*, and the hole 60 is drilled and tapped as a new hole for receiving the lock screw 62. In subsequent re-blading operations, the hole 60 may be redrilled and tapped to larger screw sizes. Subsequently, for example after several re-blading operations, when the hole 60 has been drilled and tapped to a maximum allowable size, the insert pieces 44*a*, 44*b* may be replaced to again drill and tap a new hole 60, returning to a smaller screw size. Accordingly, the present invention permits the life of the rotor disc 16 to be extended, facilitating repair of the portion of the disc 16 forming the blade lock structure 10.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A blade lock structure for blading an axial flow turbine having a rotor and blades, wherein said blades are inserted into an undercut blade groove of the rotor providing a positive lock between the blades and the rotor, the lock structure comprising:

an entry slot located in said blade groove for receiving said blades for insertion to said undercut blade groove;

a last blade including a last blade root having a generally planar face;

an insert space axially extending from said entry slot, said insert space defining a radially extending longitudinal axis and including axially extending side walls;

an insert piece in positive-locking relationship with said insert space, said insert piece comprising a unitary member including an outer wall having opposing axially extending sides and a generally planar blade engaging face extending between said axially extending sides and engaged with said generally planar face of said last blade root, said insert piece sides and said insert space side walls including cooperating features for radial retention of said insert piece in said insert space; and a lock screw threadably engaged with both said insert piece and said last blade root.

2. The blade lock structure of claim 1, wherein said cooperating features comprise generally V-shaped thread features in said outer wall of said insert piece and said side walls.

3. The blade lock structure of claim 1, wherein said insert piece and said blade root each define a radial half-hole, and said radial half-holes align longitudinally to form a threaded hole receiving said lock screw.

4. The blade lock structure of claim 1, wherein said generally planar wall of said insert piece defines a circumferentially extending surface within said blade groove for engaging said last blade root inserted into said blade groove.

5. The blade lock structure of claim 4, wherein said insert piece comprises an inlet insert piece and including an exit insert piece located within a second insert space on an axially opposite side of said blade groove from said inlet insert piece, said exit insert piece including a generally planar wall defining a circumferentially extending surface within said blade groove for engaging said last blade root.

6. The blade lock structure of claim 5, including a second lock screw threadably engaged between said exit insert piece and said last blade.

7. The blade lock structure of claim 1, including an insert locking passage extending generally parallel to said longitudinal axis, and a locking member engaged within said insert locking passage between one of said sides of said insert piece and a side wall of said insert space.

8. The blade lock structure of claim 1, wherein said cooperating features on said insert piece extend around a portion of said outer wall of said insert piece extending between said opposing side walls.

9. A blade lock structure comprising:

a rotor defining a circumferential groove, said rotor also defining an insert space extending axially from said circumferential groove, said insert space defining a radially extending longitudinal axis and said insert space including axially extending side walls;

a last blade located in said circumferential groove and including a last blade root having an axially facing face;

a unitary insert piece insertable into said insert space, said unitary insert piece including a blade engaging face engaged with said axially facing face of said last blade root, and said insert piece and said side walls including cooperating features for radial retention of said insert piece in said insert space; and a lock screw threadably engaged with both said insert piece and said last blade root.

10. The blade lock structure of claim 9, wherein said insert piece is insertable in a direction transverse to said longitudinal axis into said insert space.

11. The blade lock structure of claim 9, wherein said cooperating features comprise generally V-shaped thread features in said insert piece and said side walls.

12. The blade lock structure of claim 9, wherein said insert piece and said blade each define a radial half-hole, and said radial half-holes align longitudinally to form a threaded hole receiving said lock screw.

13. The blade lock structure of claim 9, wherein said insert piece comprises an inlet insert piece, and including an exit insert piece located within a second insert space on an axially opposite side of said circumferential groove from said inlet insert piece, said circumferential groove and said inlet and exit insert pieces defining a parallelogram opening for receiving blades into said circumferential groove.

14. The blade lock structure of claim 13, wherein said inlet and exit insert pieces each define a planar wall for engaging with said last blade inserted into said circumferential groove.

15. The blade lock structure of claim 9, wherein said unitary insert piece includes an outer wall having opposing axially extending sides and said cooperating features on said insert piece extend along said opposing side walls and around a portion of said outer wall extending between said opposing side walls.

16. A process for repairing a blade lock structure for blading an axial flow turbine having a rotor defining a circumferential groove and blades, said rotor also provided with an insert space extending axially from said circumferential groove, said insert space defining a radially extending longitudinal axis, the process comprising the steps of:

inserting a unitary insert piece into said insert space, said insert piece including a blade engaging face;

inserting a blade in said circumferential groove adjacent said insert piece to position an axially facing face of said blade in engagement with said blade engaging face of said insert piece, wherein said insert space includes side walls and said insert piece and said side walls include cooperating features for radial retention of said insert piece in said insert space, and said step of inserting said insert piece comprises moving said insert piece in a direction transverse to said longitudinal axis to move said cooperating features into engagement with each other;

drilling and tapping a hole between said insert piece and said blade, said hole being defined in both said insert piece and said blade; and threadably engaging a lock screw in said hole, said lock screw threadably engaging both said insert piece and said blade.

17. The process of claim 16, wherein said step of inserting said insert piece comprises placing said insert piece in said circumferential groove prior to insertion into said insert space.

* * * * *